US005147974A

United States Patent [19]

Bai et al.

[11] Patent Number: 5,147,974

[45] Date of Patent: Sep. 15, 1992

[54] UNWINDING RIBBON SAFING AND ARMING DEVICE

[75] Inventors: Monty W. Bai, Scottsdale; Danny E. Minks, Phoenix; Alfred B. Meyer, Mesa, all of Ariz.

[73] Assignee: Motorola Inc., Schaumburg, Ill.

[21] Appl. No.: 609,677

[22] Filed: Nov. 6, 1990

[51] Int. Cl.[5] ..... F42C 15/23; F42C 15/26

[52] U.S. Cl. ..... 102/238; 102/240; 102/245

[58] Field of Search ..... 102/237, 238, 244, 245, 102/255, 240

[56] References Cited

U.S. PATENT DOCUMENTS

| | | | |
|---|---|---|---|
| 3,302,572 | 2/1967 | Lindberg et al. | 102/245 |
| 3,450,048 | 6/1969 | Guerne | 102/240 |
| 3,516,359 | 6/1970 | Weber et al. | 102/240 |
| 3,734,023 | 5/1973 | Kaiser et al. | 102/238 |
| 4,662,279 | 5/1987 | Popovitch | 102/245 |

FOREIGN PATENT DOCUMENTS

| | | | |
|---|---|---|---|
| 708680 | 7/1931 | France | 102/238 |
| 2456936 | 12/1980 | France | 102/245 |

OTHER PUBLICATIONS

U.S. Army Material Command, (Engineering Design Handbook), Ammunition Series, pp. 6–12, titled "Spiral Unwinder", Nov. 1969.

*Primary Examiner*—Stephen M. Johnson
*Attorney, Agent, or Firm*—Jeffrey D. Nehr

[57] ABSTRACT

In a weapon subject to linear acceleration and spin, including a detonator and an explosive charge, the safing and arming device comprising a housing, a setback spring configuration restraining a ribbon spiral unwinder, and a detonator-enabling circuit which provides a fail safe for the omission of the safing and arming device from the fuze assembly.

28 Claims, 6 Drawing Sheets

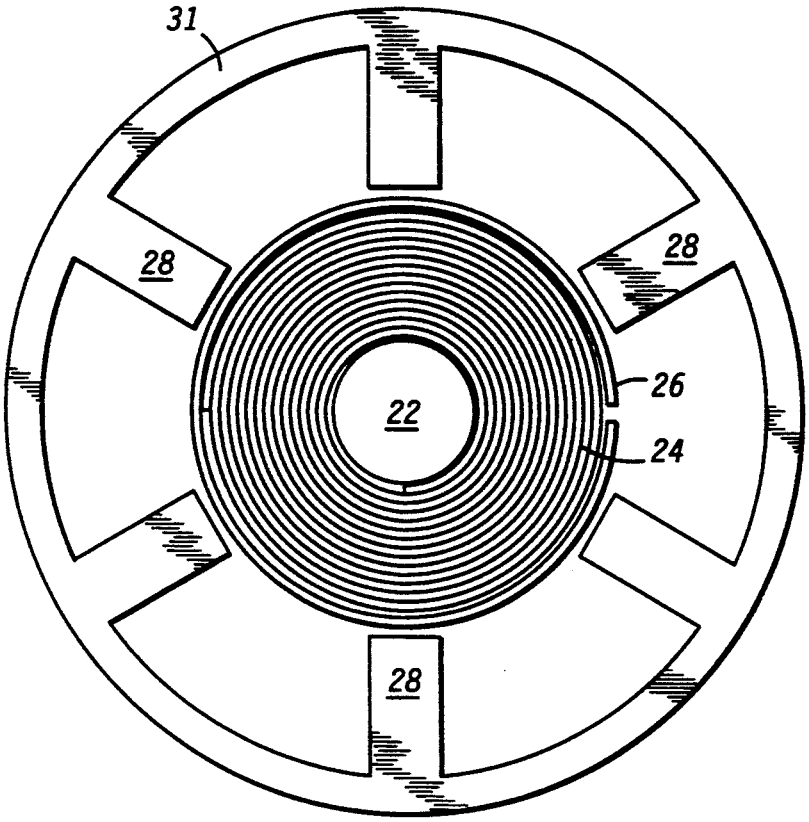
FIG. 4
FIG. 6
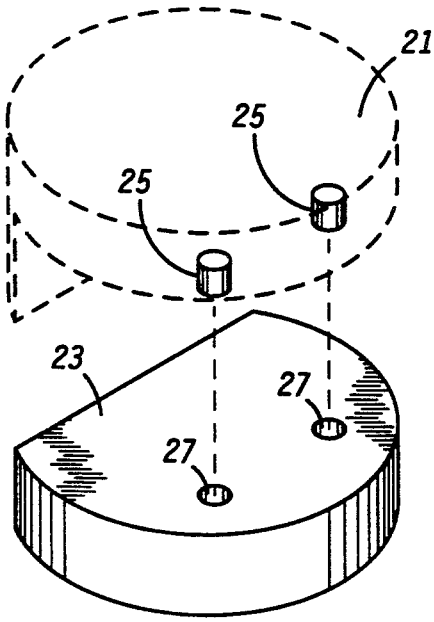

UNWINDING RIBBON SAFING AND ARMING DEVICE

BACKGROUND OF THE INVENTION

This invention relates in general to the field of munitions, and more specifically to the safing and arming of explosive shells or projectiles fired at high velocities from an internally-rifled gun.

Systems comprising an explosive shell typically consist of a fuze assembly, including an antenna, radar system, battery, and safing and arming device, as well as a detonator, detonator booster and high explosives. The safing and arming device within the fuze is designed to provide a safe separation distance from the gun launch site to the site of actual arming of the explosive shell. Generally, at least two independent means within the safing and arming device are employed to ensure safe operation.

One type of safing and arming device is termed "in-line", referring to a linear configuration of a detonator, barrier, and detonator booster and high explosive. The barrier, which is a component of the safing and arming device, is locked in an obstructing position between the detonator and the detonator booster and high explosive, providing a safe configuration when the shell is fired. The barrier is subsequently removed at a predetermined time by the action of the safing and arming device, thereby allowing the detonator to trigger the detonator booster and high explosive at a predetermined time.

Many traditional electro-mechanical safing and arming devices rely on a source of electrical power, such as a battery, to perform arming using a piston actuator and an electrical detonator. Disadvantages of such safing and arming devices, particularly in small, e.g. 35-millimeter caliber weapons, can be undependability and high cost. Batteries occupy a significant amount of space and require recharging or replacement after time. Even in systems where a battery is required to power other fuze components (and thus cannot be omitted from the fuze assembly), the battery can be reduced in size and weight by the use of a non-electrical safing and arming device. Furthermore, electrical connections in electrical safing and arming devices are subject to high stress during acceleration and spin and represent an additional possible mode of failure for the safing and arming device.

Typical mechanical safing and arming devices, especially if complex, can also be undependable and intolerant of rough handling. This is true particularly where the devices employ delicate mechanisms such as escapements. Some mechanical safing and arming devices also use mechanisms that cannot be tested and reused. Testing and reuse is important in producing safing and arming devices with well-known characteristics.

Finally, neither electrical nor mechanical safing and arming devices generally provide protection with respect to the omission during manufacture of the safing and arming device barrier from the fuze assembly. An unsafe condition results from such an omission because the obstruction between the detonator and high explosive is a principal safety means of the device. Without the barrier "fail safe" provision, a single contingency, such as the accidental firing of the detonator, could explode the shell.

An additional constraint on safing and arming devices is that the current United States military standard relating to the safety of weapon fuze designs (MILL-STD-1316D) requires that no stored energy be used in the arming process. Thus, no spring-actuated mechanisms or stored potential-energy driven systems are permissible in current U.S. safing and arming devices.

SUMMARY OF THE INVENTION

It is therefore an advantage of the invention to provide a dependable, reliable safing and arming device. It is also an advantage to provide a compact safing and arming device of small mass, which is capable of being tested and reused. Still another advantage is to provide a fail safe provision for the inadvertent omission of the safing and arming device in the manufacture of the fuze assembly.

To achieve these advantages in a weapon or projectile which includes a detonator, detonator booster and high explosives and which is subject to a sequence of acceleration and spin, a safing and arming device of an embodiment of the invention comprises a housing, barrier, locking mechanism, timing mechanism, and restraining mechanism. The barrier is located between the detonator and detonator booster (the latter with immediately adjacent high explosive), and forms an obstruction between the detonator and detonator booster when the weapon is in the safe mode. The barrier can be immediately surrounded by the mechanical timing mechanism, locking mechanism, and restraining mechanism. A portion of the timing mechanism can be used to complete an electric circuit to arm the detonator. This provides safing protection if the safing and arming device is mistakenly omitted from the fuze during assembly.

In operation, the restraining mechanism responds to the acceleration and spin from the firing of the weapon and initiates the mechanical timing mechanism. The timing mechanism of an embodiment of the invention comprises a metal ribbon which unwinds as the weapon spins, and, after a predetermined time interval, triggers the release of the locking mechanism holding the safing and arming barrier. The release of the locking mechanism allows the barrier to move outward from its position between the detonator and high explosives of the weapon. The detonator is capable of triggering the detonator booster and high explosive.

Other advantages of the present invention will become apparent from the following detailed description, particularly when considered in conjunction with the accompanying drawings.

BRIEF DESCRIPTION OF THE DRAWINGS

FIG. 4 is a top view of the safing and arming device;

FIG. 6 is an isometric view of a multiple-piece barrier;

DETAILED DESCRIPTION OF THE PREFERRED EMBODIMENTS

Figure 1:
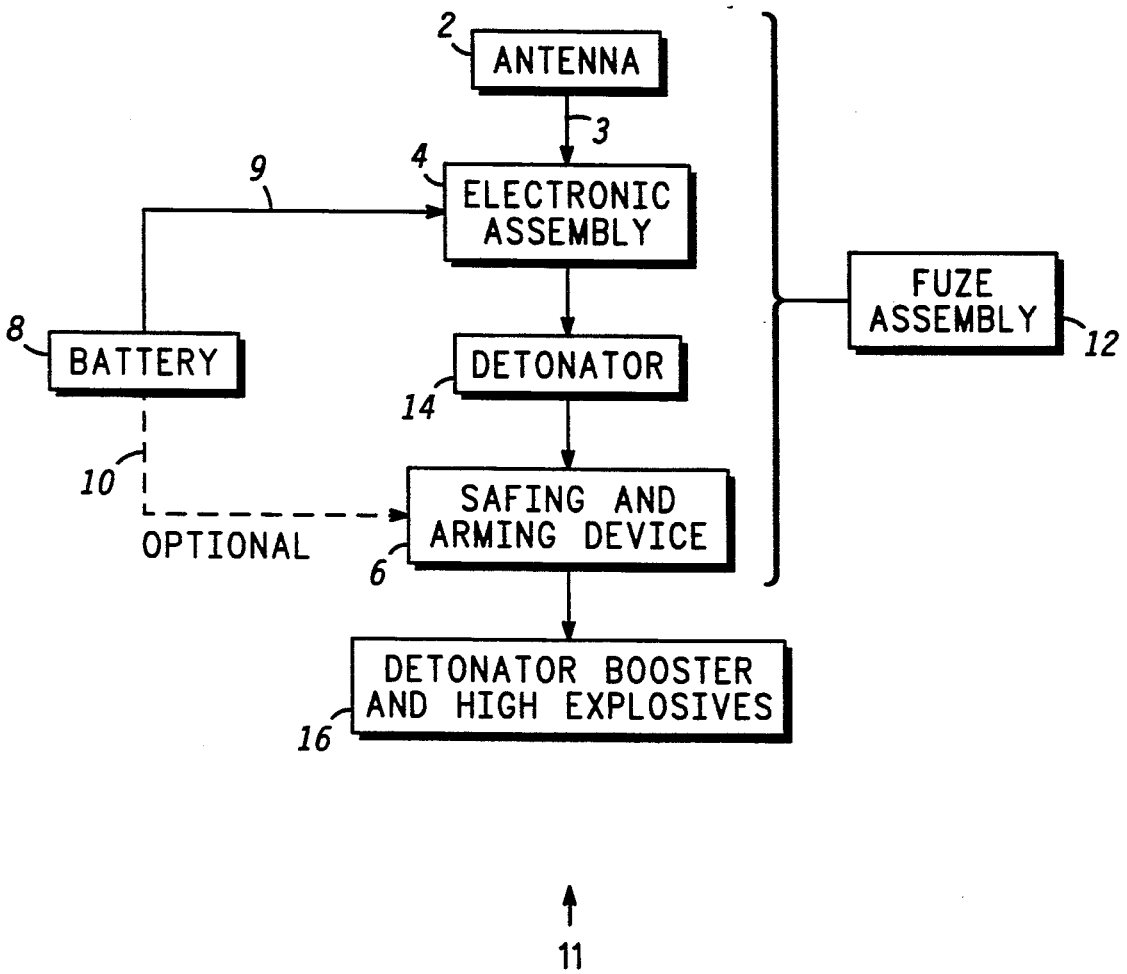
FIG. 1 is a block diagram of the fuze assembly, detonator, and detonator booster and high explosive system of the weapon.
Figure 2:
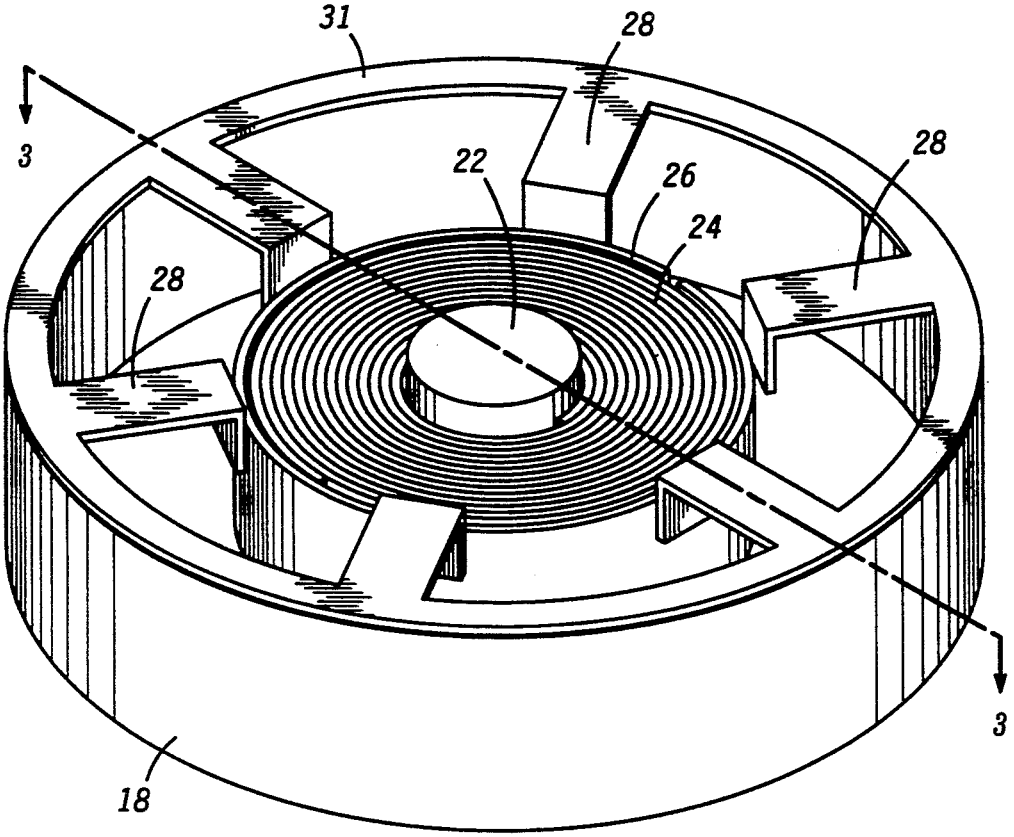
FIG. 2 is an isometric view of a safing and arming device.
Figure 3:
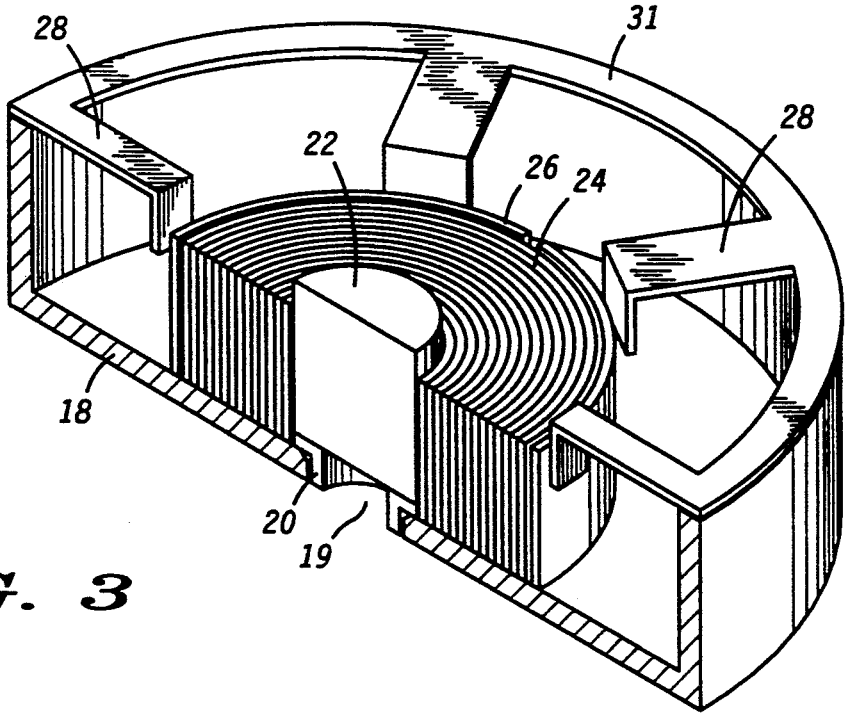
FIG. 3 is a cutaway view along line 3—3 of FIG. 2.
Figure 5:
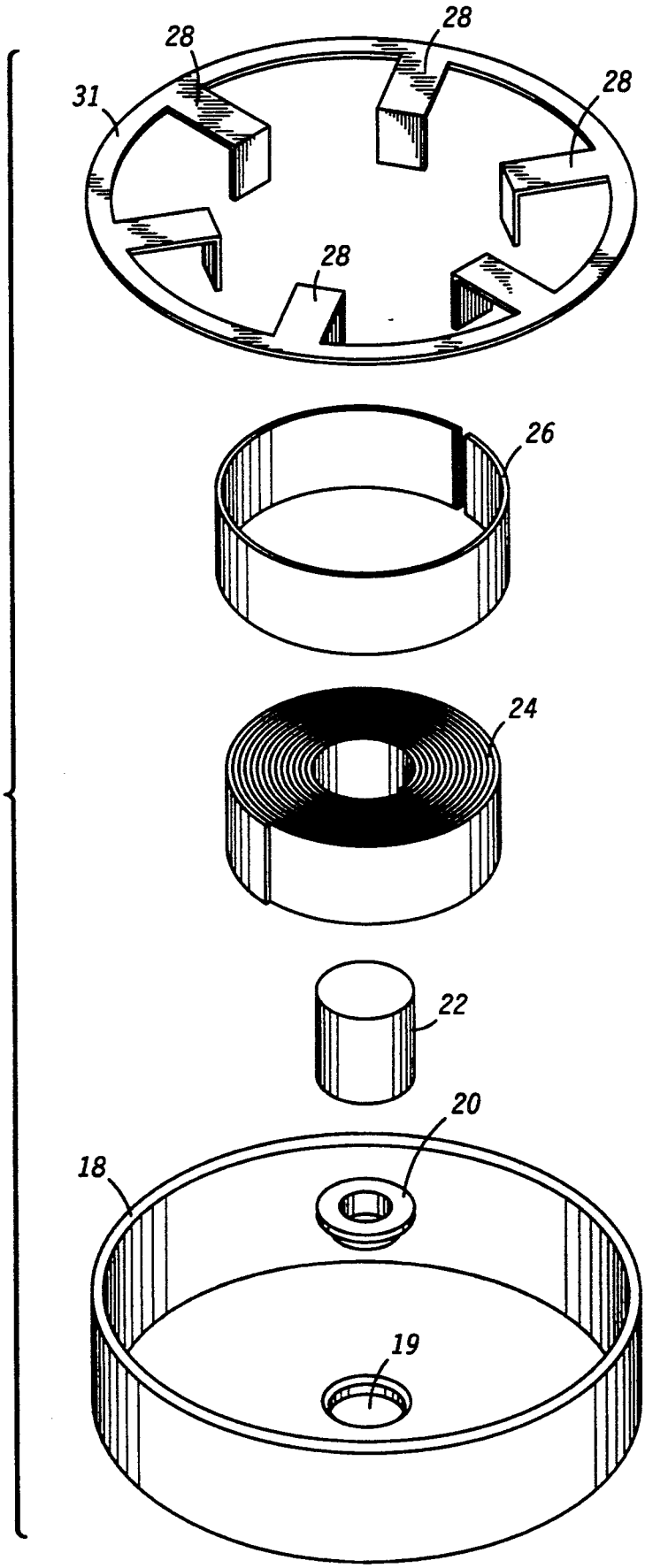
FIG. 5 is an exploded isometric view of the safing and arming device.

In FIG. 1, there is shown a block diagram of a weapon system 11. System 11 can be primarily intended for use in conjunction with small-caliber weapons, e.g. 30 to 40-millimeter caliber projectiles, for instance. These explosive shells can be launched with linear accelerations of 40,000 to 90,000 times the acceleration due to gravity at the earth's surface, and spun by gun rifling at 40,000 to 50,000 revolutions per minute.

System 11 comprises a fuze assembly 12, detonator 14, and detonator booster and high explosive 16. The fuze assembly 12 comprises an antenna 2, an electronic assembly 4, a safing and arming device 6, and a battery 8. The antenna 2 provides a signal to the electronic assembly 4 which determines a target distance for an optimum warhead performance. The safing and arming device 6 can be mechanical, electrical, or electromechanical. In the latter two instances, device 6 can be powered by the battery 8. At a predetermined time after launch of the weapon, the safing and arming device 6 enables the weapon by deactivating safety mechanisms and arming the device to explode when the detonator 14 is triggered. The detonator 14 sets off the detonator booster and high explosive 16.

FIGS. 2–5 show an embodiment of the present invention. They show a housing 18 with central aperture 19, in which sits a hub 20. The aperture 19 provides an opening directly between the detonator 14 and detonator booster and high explosive 16 of the weapon system (see FIG. 9), unless the aperture 19 is obstructed by the barrier 22. The barrier 22 sits on the hub 20, and that portion of the hub 20 above the housing 18 and the barrier 22 are encircled in turn by the electrically-conductive wound ribbon 24, the "C" spring 26 and the setback springs 28, mounted on the setback spring ring 31.

In the safe mode, the C spring 26 surrounds the outermost winding of the wound ribbon 24 which is wrapped tightly around the barrier 22. The wound ribbon 24 can be comprised of electrically conductive material that deforms easily without behaving like a spring. The setback springs 28 compress the C spring 26, maintaining the barrier 22, hub 20, and wound ribbon 24 centered over the aperture 19

The outer silhouette of the setback spring ring 31 is circular and defines a plane that remains perpendicular to the direction of motion of the center of mass of the projectile throughout the period from gun launch until weapon detonation. The spin of the projectile is about an axis perpendicular to the setback spring ring plane which intersects the geometric center of safing and arming device. Hence, the axis of spin of the projectile is aligned with the direction of motion of the center of mass of the projectile.

During the early stage of the gun launch of the weapon from a rifled barrel, the setback springs 28 bend toward the inner surface of the housing 18 and away from the barrier 22 due to the torque created by their own inertia under the influence of the weapon's setback acceleration. The setback springs 28 maintain their bent positions away from the C spring 26 due to the weapon's spin. In the one embodiment of the invention, the setback spring 28 material is such that the setback springs 28 return to their original shape after being subject to the acceleration and spin of weapon launch. The safing and arming device incorporating setback springs 28 is therefore testable and reusable. After the setback springs 28 bend and move outward from the axis of rotation of the projectile, the C spring 26 opens and moves away from the wound ribbon 24 assembly under the action of spin. From that moment, the wound ribbon 24 is ready to unwind by pulling and peeling. The wound ribbon 24 can be made of aluminum foil. Aluminum foil can be made to deform properly without behaving as a spring as the ribbon 24 unwinds in the safing and arming device. The barrier 22 rotates on the hub 20 due to the pulling of the ribbon 24.

After the unwinding process is completed, the barrier 22 moves away from covering the central aperture 19 since the barrier 22 cannot maintain a central position (of unstable equilibrium) within the housing 18 given the inevitable vibration of the weapon spinning through the air. When the barrier 22 clears the aperture 19, exposing the detonator booster and high explosive combination 16 to the detonator 14, the weapon is armed. For a given spin rate, the distance over which the weapon travels before arming is a function of the number of winds and the thickness of the wound ribbon 24 as well as the moment of inertia of the barrier 22.

The barrier 22 can be one piece if the outer diameter of the safing and arming device is sufficiently large such that the barrier 22 does not cover the center aperture 19 after the barrier moves away from the center and against the housing 18. Multiple-piece barriers such as in FIG. 6 can be necessary where larger aperture 19 diameter to housing 18 diameter ratios are required.

FIG. 6 shows an alternate embodiment of the barrier, consisting of two interlocking pieces 21 and 23. The multiple-piece barrier 21 and 23 is held together by pegs 25 attached to barrier piece 21 which fit into holes 27 in barrier piece 23.

Figure 7:
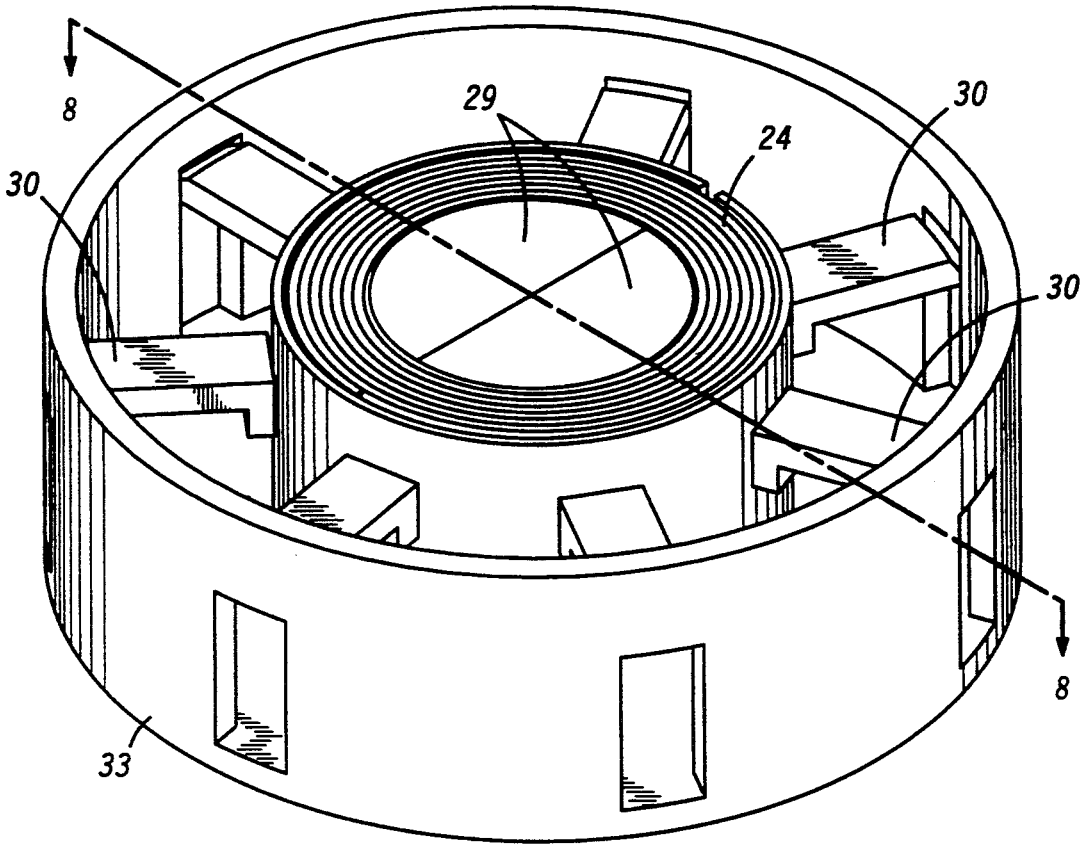
FIG. 7 is an isometric view of the safing and arming device with a multiple-piece barrier and alternate version of setback springs.
Figure 8:
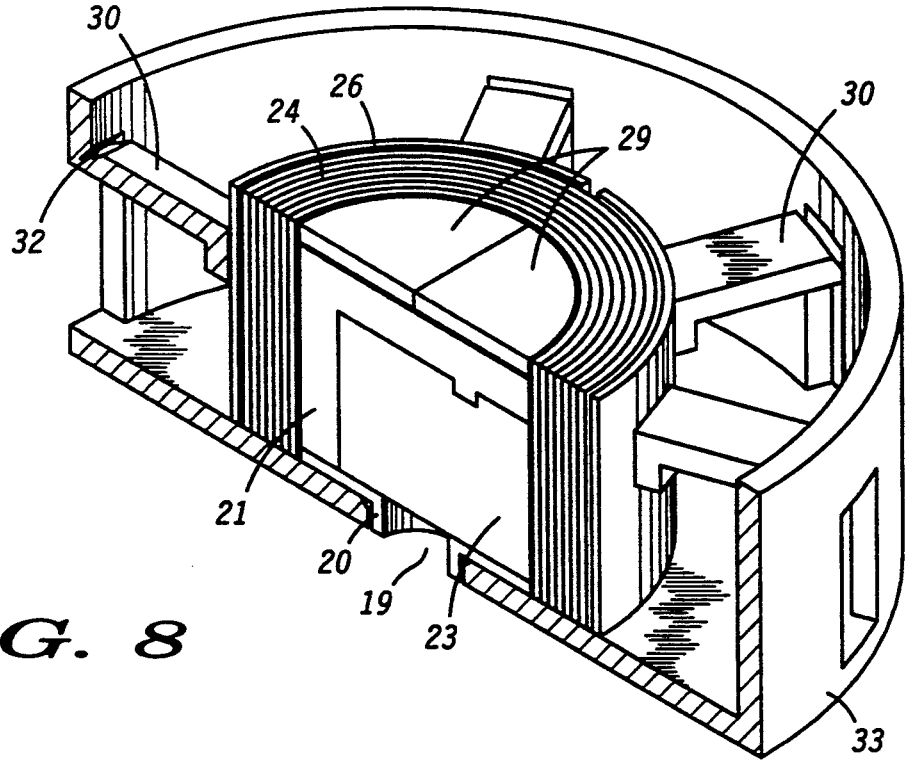
FIG. 8 is a cutaway side view along line 8—8 of FIG. 7.

FIGS. 7–8 show an isometric view and cutaway isometric view of the multiple-piece barrier 21 and 23 in conjunction with an alternate embodiment of setback springs, i.e., setback tabs 30 Covering the multiple-piece barrier 21 and 23 are two shims 29 which prevent the interlocking pieces of the multiple-piece barrier 21 and 23 from moving along the direction of the axis of spin of the projectile until after the wound ribbon 24 has completely pulled away from the hub 20 and barrier 21 and 23. The pieces 21 and 23 stay together under the high spin rate of the weapon so long as the barrier piece 21 is prevented from separating from barrier piece 23 by more than the length of the pegs 25. The length of the pegs 25, however, is less than the thickness of the shims 29 as measured along the axis of rotation of the projectile, and the centers of mass of the parts of the multiple-piece barrier 21 and 23 are offset from both the axis of rotation of the projectile and the peg 25 locations.

In the operation of the alternate embodiment of the multiple-piece barrier 21 and 23, the shims 29 move outward from the axis of rotation of the projectile under the action of spin of the projectile once the wound ribbon 24 has unwound completely. Since the shims 29 then no longer constrain the multiple-piece barrier 21 and 23, the piece of the barrier 21 is free to move forward along the direction of motion of the axis of rotation of the projectile due to the vibration of the weapon after launch and the off-set centers of mass of the barrier pieces 21 and 23 under spin. This separates barrier pieces 21 and 23 by more than the length of the pegs 25.

The centrifugal force within the accelerated reference frame of the rotating weapon causes the separated pieces of the multiple-piece barrier 21 and 23 to move outward against the inner portion of the housing 18. When the multiple-piece barrier 21 and 23 clears the aperture 19, exposing the detonator booster and high explosive 16 to the detonator 14, the weapon is armed.

FIG. 8 shows a cutaway isometric view along line 8—8 of FIG. 7. The shims 29, multiple-piece barrier 21 and 23, and hub 20 are all held centered over the aperture 19 by the wound ribbon 24, C spring 26, and an alternate version of the setback springs, the setback tabs, 30. In practice, the shims 29 are prevented from moving along the axis of rotation of the projectile by the detonator 14 in the completed fuze assembly 12.

FIG. 8 also shows an alternate embodiment of setback springs, i.e., setback tabs 30, which bend and break under the action of setback acceleration and spin described above. The setback tabs 30 are cut and bent from a thin cylinder of spring material 33 with the longitudinal axis of the cylinder aligned along the axis of spin of the projectile. In this embodiment, spring material has been removed at location 32 in the area of the bend of the setback tabs 30 where the setback tabs 30 meet the cylinder of spring material 33. The material removed at 32 from the setback tabs 30 is sufficient to make the setback tabs 30 break from the cylinder of spring material 33 on setback acceleration of the weapon. The broken setback tabs 30 move outward against the inner surface of the safing and arming housing 18 under the action of spin of the projectile and therefore do not interfere with the expansion of C spring 26 and the unwinding of the wound ribbon 24 in the arming process of the weapon.

Figure 9:
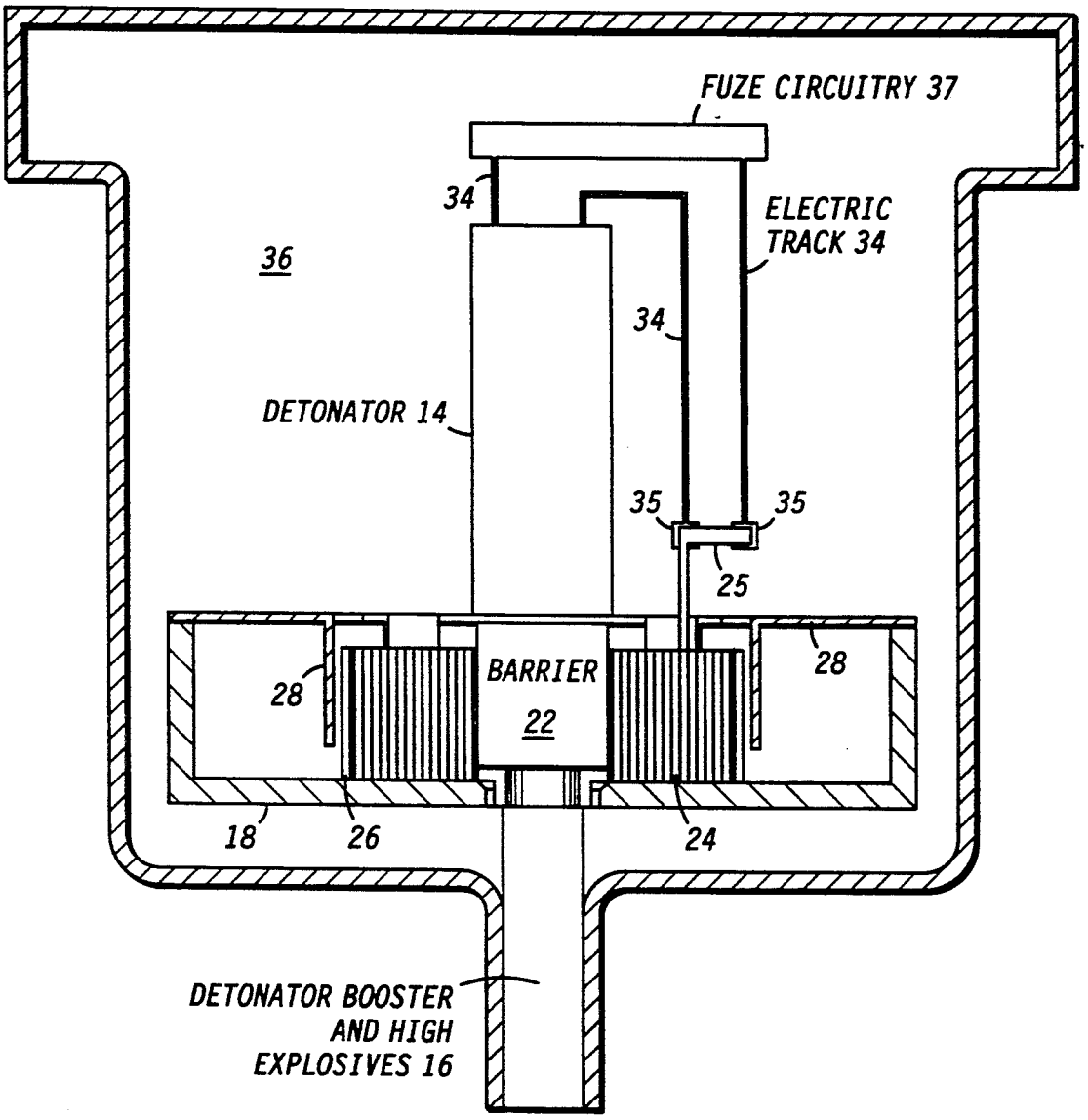
FIG. 9 is a cross-sectional view of the safing and arming device coupled with a detonator enabling circuit.

FIG. 9 shows a cross-sectional view of the safing and arming device coupled with an enabling circuit for electrical detonator 14. An electric circuit requiring completion to arm the detonator 14 can be comprised of electric track 34 from the fuze circuitry 37 as illustrated in FIG. 9. The electric circuit can be powered by the battery 8 which powers the electronic assembly 4 within the fuze assembly 12. The battery 8 can be part of the fuze circuitry 37, or coupled to the fuze circuitry 37, as is typically done in the art. The battery 8 can provide the power to explode the detonator 14 at the proper time. The electric track 34 is integrated directly into a molded fuze housing 36. The electrical fuze circuitry 37 to enable the detonator 14 can be completed by a portion 25 of the wound ribbon 24, if the ribbon 24 is made of electrically conductive material such as aluminum foil. The portion 25 of the ribbon 24 acts as part of the enabling circuit for the electrical detonator 14 only if properly installed during assembly of the safing and arming device 6. During manufacture, portion 25 of the wound ribbon 24 is connected between ends 35 of electric track 34, by soldering for instance. Hence, if the safing and arming device 6 is inadvertently omitted during manufacture, detonator 14 is disabled because the portion 25 of the ribbon 24 is missing. The portion 25 of the wound ribbon 24 is unaffected by the unwinding of the ribbon 24 during safing and arming device operation, since the portion 25 has been securely fastened between ends 35 of electric track 34.

There are several advantages of the safing and arming device with the electrical detonator 14 enabling circuit in addition to the feature that inadvertent omission of the safing and arming device from the fuze assembly during manufacture disables the detonator 14. The molding of the electrical circuit path 34 into the fuze housing 36 improves the reliability of the weapon. The integrated manufacture lessens assembly steps and lessens the likelihood of a poor electrical connection in the circuit enabling the detonator 14 due to the ruggedness of the molded conductive track 34.

A safing and arming mechanism has been described which overcomes specific problems and accomplishes certain advantages relative to prior art mechanisms. The need for electrical power for the arming process is eliminated in the described safing and arming device, saving critical space and weight in a projectile fuze assembly, and complying with the current U.S. military requirement that no stored energy be used for weapon arming. Increased reliability in a simple, rugged package results from the embodiments described, including molded electrical detonator connections and testable setback springs. The fail-safe capability of completing an electrical detonator-enabling circuit with a portion of a spiral ribbon unwinder additionally provides a distinct safety advantage for the safing and arming device described.

What is claimed is:

1. A control system for a projectile, including in combination:

antenna means;

electronic assembly means coupled to the antenna means;

a battery coupled to the electronic assembly means;

safing and arming means coupled to the electronic assembly means; the safing and arming means having a housing; a barrier forming an obstruction between a detonator and a detonator booster, the barrier being completely removable from between the detonator and the detonator booster under the action of a spin on the barrier; locking means which lock the barrier in a position forming the obstruction until released, the locking means including a spring means operating to release the barrier; timing means which trigger the release of the barrier at a predetermined time after the initiation of an acceleration; and restraining means which disengage the locking means on the acceleration;

the detonator coupled to the safing and arming means; and the detonator booster coupled to the detonator.

2. The control system as recited in claim 1, wherein the battery is additionally coupled to the safing and arming means.

3. The control system as recited in claim 1, wherein the locking means includes a C spring encircling the barrier until the release.

4. The control system as recited in claim 3, wherein: the timing means includes a spirally- wound ribbon wrapped around the barrier, the ribbon being responsive to a predetermined number of the spins to completely unwind and trigger the release of the barrier; and the locking means further includes a hub which lies between the barrier and the housing, and which is wrapped by the ribbon.

5. The control system as recited in claim 4, wherein the barrier consists of one piece and the interior diameter of the housing is sufficiently large compared to the barrier such that the barrier does not continue to provide the obstruction on the release.

6. The control system as recited in claim 5, wherein the restraining means comprises setback springs, which bend toward the inner surface of the housing and away from the barrier due to the acceleration and maintain the bent position due to the spin.

7. The control system as recited in claim 6, wherein:

the detonator includes an enabling circuit, required to be electrically completed before the detonator is enabled;

the ribbon is made of electrically-conductive material; and a portion of the ribbon extends from its spirally-wound configuration to electrically complete the detonator enabling circuit.

8. The control system as recited in claim 7, wherein the setback springs have been altered to break when the bending occurs.

9. A weapon subject to an acceleration and a spin about a spin axis, the weapon including a detonator and an explosive charge and comprising:

a housing;

a barrier forming an obstruction in line along the spin axis between the detonator and the charge, the barrier being completely removable from between the detonator and the charge under the action of the spin on the barrier;

locking means which locks the barrier in a position forming the obstruction until the barrier is released, the locking means including spring means operating to release the barrier;

timing means which triggers the release of the locking means at a predetermined time after the initiation of the acceleration; and restraining means which disengages the locking means in response to the acceleration.

10. The weapon system of claim 9 wherein the locking means includes a C spring encircling the barrier.

11. A weapon as recited in claim 9, wherein:

the timing means includes a spirally-wound ribbon wrapped around the barrier, the ribbon being responsive to a predetermined number of the spins to completely unwind and trigger the release of the barrier; and the locking means further includes a hub which lies between the barrier and the housing, and which is wrapped by the ribbon.

12. A weapon as recited in claim 11, wherein the barrier consists of one piece and the interior diameter of the housing is sufficiently large compared to the barrier such that the barrier does not continue to provide the obstruction on the release.

13. A weapon as recited in claim 11, wherein:

the barrier includes at least two interconnected pieces which interlock and resist separation under the action of the spin except on the release; and the locking means includes at least two shims which normally cover the barrier and are enclosed by the ribbon, preventing the release until the ribbon has completely unwound and the shims have been completely removed under the action of the spin.

14. A weapon as recited in claim 12, wherein the restraining means comprises setback springs, which bend toward the inner surface of the housing and away from the barrier due to the acceleration and maintain the bent position due to the spin.

15. A weapon as recited in claim 14, wherein the setback springs have been altered to break when the bending occurs.

16. A weapon as recited in claim 13, wherein the restraining means comprises setback springs, which bend toward the inner surface of the housing and away from the barrier due to the acceleration and maintain the bent position due to the spin.

17. A weapon a recited in claim 16, wherein the setback springs have been altered to break when the bending occurs.

18. A weapon as recited in claim 14, wherein:

the detonator includes an enabling circuit, required to be electrically completed before the detonator is enabled;

the ribbon is made of electrically-conductive material; and a portion of the ribbon extends from its spirally-wound configuration to electrically complete the detonator enabling circuit.

19. A weapon as recited in claim 18, wherein the setback springs have been altered to break when the bending occurs.

20. A weapon as recited in claim 16, wherein: the detonator includes an enabling circuit, required to be electrically completed before the detonator is enabled;

the ribbon is made of electrically-conductive material; and a portion of the ribbon extends from its spirally-wound configuration to electrically complete the detonator enabling circuit.

21. A weapon as recited in claim 20, where the setback springs have been altered to break when the bending occurs.

22. A safing and arming device subject to an acceleration and a spin about a spin axis, the safing and arming device including a detonator and an explosive charge and comprising:

a housing;

a barrier forming an obstruction in line along the spin axis between the detonator and the charge, the barrier being completely removable from between the detonator and the charge under the action of the spin on the barrier;

locking means which locks the barrier in a position forming the obstruction until the barrier is released, the locking means including spring means operating to release the barrier;

timing means which triggers the release of the barrier at a predetermined time after the initiation of the acceleration; and restraining means which disengages the locking means in response to the acceleration.

23. The safing and arming device as recited in claim 22, wherein the locking means includes a C spring encircling the barrier until the release.

24. The safing and arming device as recited in claim 23, wherein:

the timing means includes a spirally-wound ribbon wrapped around the barrier, the ribbon being responsive to a predetermined number of the spins to completely unwind and trigger the release of the barrier; and the locking means further includes a hub which lies between the barrier and the housing, and which is wrapped by the ribbon.

25. The safing and arming device as recited in claim 24, wherein the barrier consists of one piece and the interior diameter of the housing is sufficiently large compared to the barrier such that the barrier does not continue to provide the obstruction on the release.

26. The safing and arming device as recited in claim 25, wherein the restraining means comprises setback springs, which bend toward the inner surface of the housing and away from the barrier due to the acceleration and maintain the bent position due to the spin.

27. The safing and arming device as recited in claim 26, wherein:

the detonator includes an enabling circuit, required to be electrically completed before the detonator is enabled;

the ribbon is made of electrically-conductive material; and a portion of the ribbon extends from its spirally-wound configuration to electrically complete the detonator enabling circuit.

28. The safing and arming device as recited in claim 27, wherein the setback springs have been altered to break when the bending occurs.

* * * * *